US007419462B1

(12) United States Patent
Zelinski

(10) Patent No.: US 7,419,462 B1
(45) Date of Patent: Sep. 2, 2008

(54) PRESSWARE DIE SET WITH PNEUMATIC BLANK FEED

(75) Inventor: Thomas W. Zelinski, Menasha, WI (US)

(73) Assignee: Dixie Consumer Products LLC, Atlanta, GA (US)

( * ) Notice: Subject to any disclaimer, the term of this patent is extended or adjusted under 35 U.S.C. 154(b) by 0 days.

(21) Appl. No.: 11/451,057

(22) Filed: Jun. 12, 2006

Related U.S. Application Data

(60) Provisional application No. 60/689,818, filed on Jun. 13, 2005.

(51) Int. Cl.
*B31B 1/12* (2006.01)

(52) U.S. Cl. ..... 493/143; 493/174; 271/195; 271/211

(58) Field of Classification Search ..... 493/143, 493/174; 271/195, 211, 202–204
See application file for complete search history.

(56) References Cited

U.S. PATENT DOCUMENTS

| | | | | |
|---|---|---|---|---|
| 1,793,089 | A | | 2/1931 | Heyes |
| 2,332,937 | A | | 10/1943 | Schmidberger |
| 2,595,046 | A | | 4/1952 | Amberg |
| 2,832,522 | A | | 4/1958 | Schlanger |
| 3,228,066 | A | | 1/1966 | Rippstein |
| 3,305,434 | A | | 2/1967 | Bernier et al. |
| 4,242,293 | A | | 12/1980 | Dowd |
| 4,317,563 | A | * | 3/1982 | Zimmerman et al. ..... 271/211 |
| 4,359,214 | A | | 11/1982 | Eldridge |
| 4,435,143 | A | | 3/1984 | Dempsey |
| 4,494,745 | A | | 1/1985 | Ward, Sr. et al. |
| 4,588,539 | A | | 5/1986 | Rossi et al. |
| 4,606,496 | A | | 8/1986 | Marx et al. |
| 4,609,140 | A | | 9/1986 | Van Handel et al. |
| 4,721,499 | A | | 1/1988 | Marx et al. |
| 4,721,500 | A | | 1/1988 | Van Handel et al. |
| 4,741,196 | A | | 5/1988 | Stewart et al. |
| 4,748,792 | A | | 6/1988 | Jeffrey |
| 4,755,128 | A | | 7/1988 | Alexander et al. |
| 4,781,566 | A | | 11/1988 | Rossi et al. |
| 4,832,676 | A | | 5/1989 | Johns et al. |
| 5,017,052 | A | | 5/1991 | Bartylla |
| 5,026,040 | A | | 6/1991 | Gibert |
| 5,074,539 | A | | 12/1991 | Wells et al. |
| 5,163,891 | A | | 11/1992 | Goldsborough et al. |
| 5,203,491 | A | | 4/1993 | Marx et al. |
| 5,249,946 | A | | 10/1993 | Marx |
| 5,364,583 | A | | 11/1994 | Hayashi |
| 5,634,636 | A | | 6/1997 | Jackson et al. |
| 5,669,603 | A | * | 9/1997 | Detmers et al. ..... 271/183 |
| 5,693,346 | A | | 12/1997 | Dull et al. |
| 5,816,994 | A | | 10/1998 | Hill et al. |
| 5,945,137 | A | | 8/1999 | Mizuno et al. |
| 6,042,107 | A | | 3/2000 | Stephan et al. |
| 6,474,497 | B1 | | 11/2002 | Littlejohn et al. |
| 6,527,687 | B1 | | 3/2003 | Fortney et al. |
| 6,585,259 | B2 | | 7/2003 | Kerpe et al. |
| 6,585,506 | B1 | | 7/2003 | Johns et al. |
| 6,589,043 | B1 | | 7/2003 | Johns et al. |
| 6,592,357 | B1 | | 7/2003 | Johns et al. |
| 6,715,630 | B2 | | 4/2004 | Littlejohn et al. |
| 6,733,852 | B2 | | 5/2004 | Littlejohn et al. |

(Continued)

*Primary Examiner*—Hemant M. Desai

(57) ABSTRACT

An improved apparatus for making disposable pressware features a pneumatic feeding system which accelerates a paperboard blank into a forming die. In a typical embodiment, a pair of adjustable air knives propel a paperboard blank into the forming cavity.

10 Claims, 8 Drawing Sheets

U.S. PATENT DOCUMENTS

| | | | |
|---|---|---|---|
| 6,893,693 | B2 | 5/2005 | Swoboda et al. |
| 7,048,176 | B2 | 5/2006 | Littlejohn et al. |
| 2004/0069788 | A1 | 4/2004 | Johns et al. |
| 2005/0192171 | A1 | 9/2005 | Grischenko et al. |
| 2006/0208054 | A1 | 9/2006 | Littlejohn et al. |

* cited by examiner

PRESSWARE DIE SET WITH PNEUMATIC BLANK FEED

CLAIM FOR PRIORITY

This non-provisional application claims the benefit of the filing date of U.S. Provisional Application No. 60/689,818 of the same title, filed Jun. 13, 2005, and incorporated herein by reference.

TECHNICAL FIELD

The present invention relates to improved apparatus for making paperboard pressware such as paper plates, bowls, platters and the like from paperboard blanks. In connection with the present invention, paperboard blanks are pneumatically propelled into the forming cavity of a pressware die set.

BACKGROUND

Disposable paper plates and similar containers are generally made from either pressed paperboard or molded pulp. Molded pulp containers, after drying, are strong and rigid but generally have rough surface characteristics. They are not usually coated and are susceptible to penetration by water, oil and other liquids. Pressed paperboard containers, on the other hand, can be decorated and coated with a liquid-resistant coating before being pressed by the forming dies into the desired shape.

General background with respect to pressed paperboard containers is seen in U.S. Pat. Nos. 5,203,491 entitled "Bake-In Press-Formed Container" of R. P. Marx et al.; 4,721,500 entitled "Method of Forming a Rigid Paper-Board Container" of G. J. Van Handel et al.; 4,721,499 entitled "Method of Producing a Rigid Paperboard Container" of R. P. Marx et al.; 4,609,140 entitled "Rigid Paperboard Container and Method and Apparatus for Producing Same" of G. J. Van Handel et al.; and 4,606,496 entitled "Rigid Paperboard Container" of R. P. Marx et al., all of which are incorporated herein by reference.

The following commonly-assigned patents and co-pending patent applications contain further information as to pressware materials, processing techniques and equipment and are also incorporated herein by reference: U.S. application Ser. No. 10/963,686, entitled "Pressed Paperboard Servingware with Improved Rigidity and Rim Stiffness"; U.S. application Ser. No. 10/600,814, entitled "Disposable Servingware Containers with Flange Tabs" (Publication No. US2004-0069788A1); U.S. Pat. No. 7,048,176, entitled "Deep Dish Disposable Pressed Paperboard Container"; U.S. Pat. No. 6,893,693, entitled "High Gloss Disposable Pressware"; U.S. Pat. No. 6,733,852, entitled "Disposable Serving Plate With Sidewall-Engaged Sealing Cover"; U.S. Pat. No. 6,715,630, entitled "Disposable Food Container With A Linear Sidewall Profile and an Arcuate Outer Flange"; U.S. Pat. No. 6,592,357, entitled "Rotating Inertial Pin Blank Stops for Pressware Die Sets"; U.S. Pat. No. 6,589,043, entitled "Punch Stripper Ring Knock-Out for Pressware Die Sets"; U.S. Pat. No. 6,585,506, entitled "Side Mounted Temperature Probe for Pressware Die Sets"; and U.S. Pat. No. 6,474,497, entitled "Smooth Profiled Food Service Articles".

Equipment and methods for making paperboard containers are also disclosed in U.S. Pat. Nos. 5,249,946 entitled "Plate Forming Die Set" of R. P. Marx et al.; 4,832,676 entitled "Method and Apparatus for Forming Paperboard Containers" of A. D. Johns et al.; and 4,781,566 entitled "Apparatus and Related Method for Aligning Irregular Blanks Relative to a Die Half" of A. F. Rossi et al. In addition, applicant's co-pending U.S. patent application Ser. No. 11/057,959, entitled "Apparatus for Making Paperboard Pressware with Controlled Blank Feed" filed Feb. 15, 2005, discusses use of a variable speed blank feeder that includes a pervious feed belt, vacuum source and drive means.

The forming section of pressware apparatus may typically include a plurality of reciprocating upper die halves opposing, in facing relationship, a plurality of lower die halves. The upper die halves are mounted for reciprocating movement in a direction that is generally oblique or inclined with respect to the horizontal or vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Machine & Tool Corporation, Marion, Ind. U.S. Pat. No. 4,435,143 entitled "Small Blank Feed and Tray Former" to Dempsey describes such apparatus. See also, U.S. Pat. No. 4,242,293 to Dowd. Optionally included are hydraulic controls as described in U.S. Pat. No. 4,588,539 to Rossi et al.

For paperboard plate stock of conventional thicknesses, i.e., in the range of from about 0.010 to about 0.040 inches, it is preferred that the spacing between the upper die surface and the lower die surface is as taught in U.S. Pat. Nos. 4,721,499 and 4,721,500. Note also the following patents of general interest with respect to forming paperboard containers: U.S. Pat. No. 6,527,687 to Fortney et al. which discloses a cut-in-place forming system with a draw ring and ejection means comprising air jets; U.S. Pat. No. 3,305,434 to Bernier et al. which discloses a paperboard forming apparatus; U.S. Pat. No. 2,832,522 to Schlanger which discloses another paperboard forming apparatus; and U.S. Pat. No. 2,595,046 to Amberg which discloses yet another paperboard forming apparatus.

It is conventional in the manufacture of pressed paperboard containers to feed paperboard blanks to a die set by way of gravity, that is, by passive means. "Active" feed techniques, where paperboard webs or blanks are supplied to the die set by means other than gravity, such as by belt or chain driven conveyors, are not generally employed due to their relative complexity and the need for close synchronization with the press. Pneumatic assist for pressing paperboard articles has heretofore generally been limited to assisting in product ejection, de-nesting or stripping from the mold, or in reducing friction during conveying from one processing station to another, and these functions have been accomplished with relatively simple air nozzles and the like. For example, in connection with ejection, de-nesting or stripping of pressed paperboard articles from a mold, the following patents are noted: U.S. Pat. No. 1,793,089 entitled "Paper Utensil Forming Die" to Heyes; U.S. Pat. No. 2,332,937 entitled "Molding Press" to Schmidberger; and U.S. Pat. No. 4,755,128 entitled "Apparatus for Releasing a Press-Formed Article From a Die Set" to Alexander et al. Pneumatic assists for ejection and de-nesting of other manufactured articles are found in U.S. Pat. No. 5,364,583 entitled "Method and Device for Removing an Injection-Molded Piece From a Mold" of Hayashi, and U.S. Pat. No. 5,693,346 entitled "Automatic Molded Hardboard Unnesting System" to Dull.

In connection with air cushioning or conveying of pressed paperboard articles previously cited U.S. Pat. Nos. 4,435,143 and 4,755,128 are noted. Air cushioning in connection with production of other types of articles are found in U.S. Pat. No. 4,741,196 entitled "Air Conveyor and Method for Removing Parts from a High Speed Forming Press" to Stewart, et al.; U.S. Pat. No. 5,017,052 entitled "Cup Conveyor" to Bartylla;

U.S. Pat. No. 5,634,636 entitled "Flexible Object Handling System Using Feedback Controlled Air Jets" to Jackson et al.; U.S. Pat. No. 6,042,107 entitled "Device for Contact-Free Sheet Guidance in a Sheet-Fed Printing Press" to Stephan; and U.S. Pat. No. 6,585,259 entitled "Delivery of a Machine for Processing Flat Printing Materials" to Kerpe et al.

As to conveying equipment utilized in manufacturing operations generally, the following patents are noted: U.S. Pat. Nos. 5,945,137 to Mizuno et al.; 5,816,994 to Hill et al.; 5,163,891 to Goldsborough et al.; 5,074,539 to Wells et al.; 5,026,040 to Gibert; 4,748,792 to Jeffrey; 4,494,745 to Ward, Sr. et al.; 4,359,214 to Eldridge; and 3,228,066 to Rippstein.

It has been found in accordance with the present invention that paperboard blanks can be pneumatically propelled into a forming die by selective use of laminar air flow air knives to increase speed and reliability of the pressing operation. Air knives heretofore have been used in industrial processes primarily for drying applications. The apparatus and method of the invention eliminates moving parts as opposed to mechanical options for active blank feeding and thus requires less maintenance and capital investment as will be appreciated especially from the appended drawings.

SUMMARY OF THE INVENTION

A typical apparatus of the invention includes an inclined die set with a punch and a die adapted for reciprocal motion with respect to each other, configured to cooperate in order to form a shaped product from a substantially planar paperboard blank upon pressing thereof, as well as an inclined feed station for positioning a paperboard blank for insertion into the die set along an inclined feed path. A first air knife is upwardly disposed with respect to the feed station and has a pneumatic outlet directed toward the feed path; while a second air knife is downwardly disposed with respect to the feed station and also has a pneumatic outlet directed toward the feed path. The first and second air knives are selected and positioned so as to cooperate to propel the paperboard blank into the die set.

Further features and advantages of the present invention will become apparent from the discussion which follows.

BRIEF DESCRIPTION OF DRAWINGS

The invention is described in detail below in connection with the appended drawings wherein like numerals designate like parts and wherein.

DETAILED DESCRIPTION

The invention is described in detail below with reference to numerous embodiments for purposes of exemplification and illustration only. Modifications to particular embodiments within the spirit and scope of the present invention, set forth in the appended claims, will be readily apparent to those of skill in the art.

As used herein, terminology is given its ordinary meaning unless a more specific definition is given or the context indicates otherwise. "Mil", "mils" and like terminology refers to thousandths of an inch and dimensions are given in inches unless otherwise specified. Caliper is the thickness of material and is expressed in mils. "FPM" or "fpm" refers to feet per minute. "PSI" or "psi" refers to pounds per square inch gauge pressure unless otherwise stated.

Figure 8:
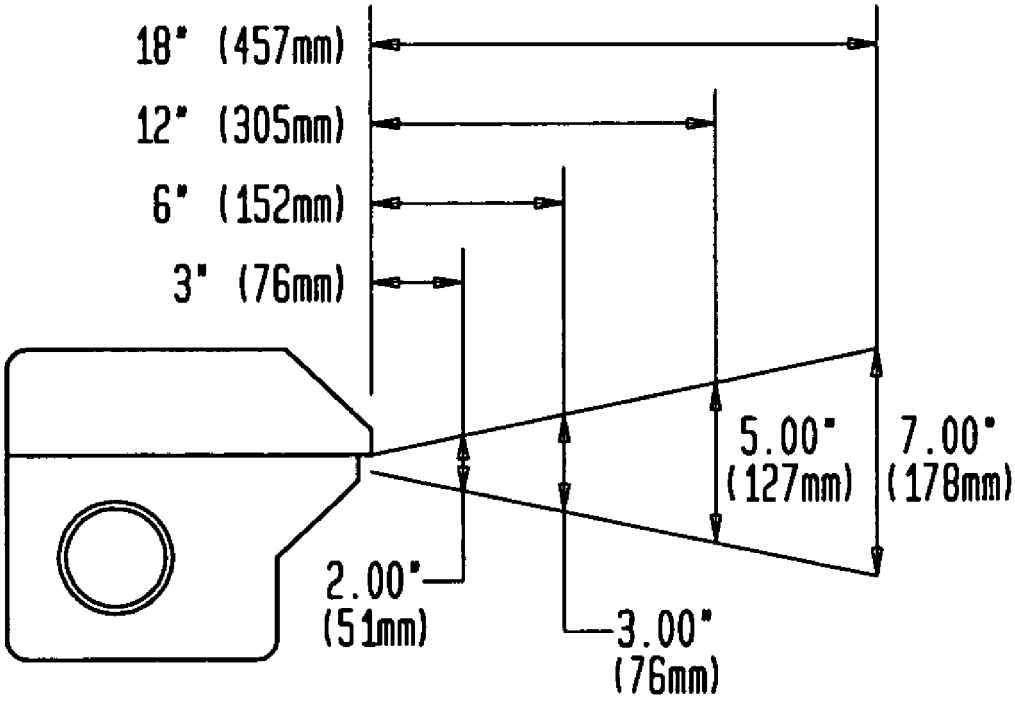
FIG. 8 is a schematic diagram illustrating the flow pattern of an air knife used with the present invention.

An "air knife" is a pneumatic device for generating a fluid jet, characterized by an elongated slot with a slot axis generally perpendicular to the path of the fluid jet which issues from the air knife. The fluid jet extends over the length of the slot, suitably in many cases resulting in a generally controlled laminar air flow with a pre-defined dispersal pattern. See FIG. 8. It has been found that a suitable air knife used in connection with the present invention for paperboard blanks will have a 3 inch slot, but other slot lengths may be used. Air knives typically have means to receive, control and filter fluid input and adjust fluid output characteristics, such as flow velocity, pressure, and dispersal patterns. Some air knives have the additional ability to reduce static electricity by introducing positive and negative ions into the fluid jet.

Pressed articles prepared by way of the invention include disposable servingware containers such as paperboard containers in the form of plates, both compartmented and non-compartmented, as well as bowls, trays, and platters. The products are typically round or oval in shape but can also be hexagonal, octagonal, or multi-sided. The containers produced by way of the invention generally include a plurality of radially extending, circumferentially spaced pleats, preferably formed of rebonded paperboard lamellae as is known in the art.

The present invention is typically practiced in connection with segmented dies generally as are known and further discussed herein. Manufacture from coated paperboard is preferred. Clay coated paperboard is typically printed, coated with a functional grease/water resistant barrier and moistened prior to blanking and forming. The printed, coated and moistened paperboard roll is then transferred to a web feed blanking press where the blanks are cut in a straight across, staggered, or nested pattern (to minimize scrap). The blanks are transferred via inclined transfer chutes to an inclined feed station immediately adjacent to the pressware die set. The transfer chutes and feed station may be integral with each other and typically will consist of parallel, slotted rails or guides adjustable to fit the dimensions of the blank. The feed station will temporarily hold and position the blank prior to the blank being fed into the die set.

During the feed step, blanks will commonly hit against forward blank stops at the forward portion of the die set (rigid or pin stops that can rotate) for final positioning prior to forming. The stop heights and locations are chosen to accurately locate the blank and allow the formed product to be removed from the tooling without interference. Typically the inner portions of the blank stops or inner blank stops are lower in height since the formed product must pass over them.

Instead of web forming, blanks may be rotary cut or reciprocally cut off-line in a separate operation. Such pre-cut blanks are typically transferred to the feed station via transfer chutes of the type described above. The overall productivity of such pre-cut blank feed style presses is typically lower than a web feed style press since the stacks of blanks must be repeatedly inserted into the feed station, the presses are commonly narrower in width with fewer forming positions available, and the forming speeds are commonly less since fluid hydraulics are typically used versus mechanical cams and gears.

As noted, the blank is typically positioned by rigid or rotating pin stops as well as by side edge guides that contact the blank diameter. The punch pressure ring contacts the blank, clamping it against the lower draw ring and optional relief area to provide initial pleating control. The upper punch and lower die knock-outs (that may have compartment ribs machined into them) then contact the paperboard holding the blank on center. The upper knock-out is sometimes an articulated style having spring pre-load and full loads and 0.030 inch to 0.120 inch articulation stroke during the formation. The pressure ring may have the outer product profile machined into it and provides further pleating control by clamping the blank between its profile area and die outer profile during the formation. The draw ring and pressure ring springs typically are chosen in the manner to allow full movement of the draw ring prior to pressure ring movement (i.e., full spring force of draw ring is less than or equal to the pre-load of the pressure ring springs).

The invention is advantageously practiced in connection with a heated matched pressware die set utilizing inertial rotating pin blank stops as described in co-pending application U.S. Ser. No. 09/653,577, filed Aug. 31, 2000, now U.S. Pat. No. 6,592,357. For paperboard plate stock of conventional thicknesses in the range of from about 0.010 to about 0.040 inches, the springs upon which the lower die half is mounted are typically constructed such that the full stroke of the upper die results in a force applied between the dies of from about 6,000 to 10,000 pounds or higher. Similar forming pressures and control thereof may likewise be accomplished using hydraulics as will be appreciated by one of skill in the art. The paperboard which is formed into the blanks is conventionally produced by a wet laid papermaking process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp fiber and is usually double clay coated on one side. Such paperboard stock commonly has a moisture (water content) varying from about 4.0 to about 8.0 percent by weight.

In a pressware apparatus for making pressed paperboard articles, the present invention provides the combination of: (a) a die set including a punch and a die adapted for reciprocal motion with respect to each other and configured to cooperate in order to form a shaped product from a substantially planar paperboard blank upon pressing thereof; (b) a feed station for positioning a paperboard blank for insertion into said die set; and (c) means for pneumatically propelling the paperboard blank from the feed station into the die set.

The means for pneumatically propelling the paperboard blank include means for providing a first fluid jet, the means for providing the first jet being upwardly disposed at a predetermined distance and orientation with respect to a paperboard blank in the feed station such that the first jet is downwardly directed at an oblique angle with respect to a production direction and incident upon a paperboard blank in the feed station, the angle, distance, flow rate, fluid pressure, and fluid dispersal pattern of the first jet being selected so as to be operative to accelerate the paperboard blank into the die set.

The means for pneumatically propelling the paperboard blank typically also include means for providing a second fluid jet, the means for providing the second jet being downwardly disposed with respect to the feed station at a predetermined distance and orientation with respect to a paperboard blank in the feed station such that the second jet is upwardly directed at an oblique angle with respect to a production direction and incident upon a paperboard blank in the feed station, the angle, distance, flow rate, fluid pressure, and fluid dispersal pattern of the second jet being selected so as to promote propelling the paperboard blank into the die set.

The fluid jets are suitably nozzles or air knives. Perhaps the most convenient fluid is compressed air at pressures of from about 10 psi to about 100 psi. From about 15 psi to about 50 psi is sufficient in many cases. Conventional means may be used to supply the fluid, such as readily available commercial air compressors. Suitable air knives have a characteristic jet height spread of about 6 inches or less at 1 foot and exhibit a characteristic pneumatic force of at least about 0.05 lbs. Typically and preferably, the first upper jet makes an oblique angle with the production direction of from about 10 to about 35° while the second jet makes an angle with the production direction of from about 5° to about 60°. Other angles may be used.

The die set and the production direction are generally inclined at an angle of from about 30° to about 60° with respect to horizontal. Optionally included are stop means for retaining a paperboard blank in the feed station such that the blank is stationary while a container is formed from another blank. The stop means may be a pin or any suitable clamp. There is typically provided control means for synchronizing the means for pneumatically propelling the paperboard blank into the die set with the reciprocal motion of the die set, wherein the means for pneumatically propelling the blank are active during feeding of a blank to the die set and inactive during formation of a container.

A method of making a pressed paperboard container in accordance with the invention includes: (a) positioning a substantially planar paperboard blank in a feed station such that the paperboard blank is substantially stationary; (b) pneumatically propelling the blank into a die set including a punch and a die adapted for reciprocal motion with respect to each other and configured to cooperate in order to form a shaped product from the substantially planar paperboard blank upon pressing thereof; and (c) forming the container in the die set. The step of pneumatically propelling the blank into the die set is carried out in a feed step with a pulsed jet, the pulsed jet being synchronized with the feed step and forming step such that the jet is on during at least a portion of the feed step and off during forming of the related container.

Generally, the paperboard blank is pneumatically propelled into the die set at a peak velocity of at least about 1000 fpm; typically at a peak velocity at least about 750 fpm up to about 3000 fpm or more. The paperboard blank has a caliper from about 10 to about 25 mils in preferred embodiments, and in any event a caliper of at least about 5 mils. Likewise, the paperboard blank is made from paperboard having a basis weight of from about 150 to about 250 lbs per 3000 square foot ream and is a scored paperboard blank.

Suitably, the process is operated at a production rate or frequency of at least about 40 cycles per minute.

It is thought that advantages of the invention are or may be: increased press productivity; reduction in blank misfeeds;

reduction in or removal of air turbulence and static electricity (if present) created by friction in reciprocal operation of the die set; evacuation of moisture from the die set; and the ability to inject release agents and/or additives, such as fragrances and deodorizers, directly into the die set.

Figure 1:
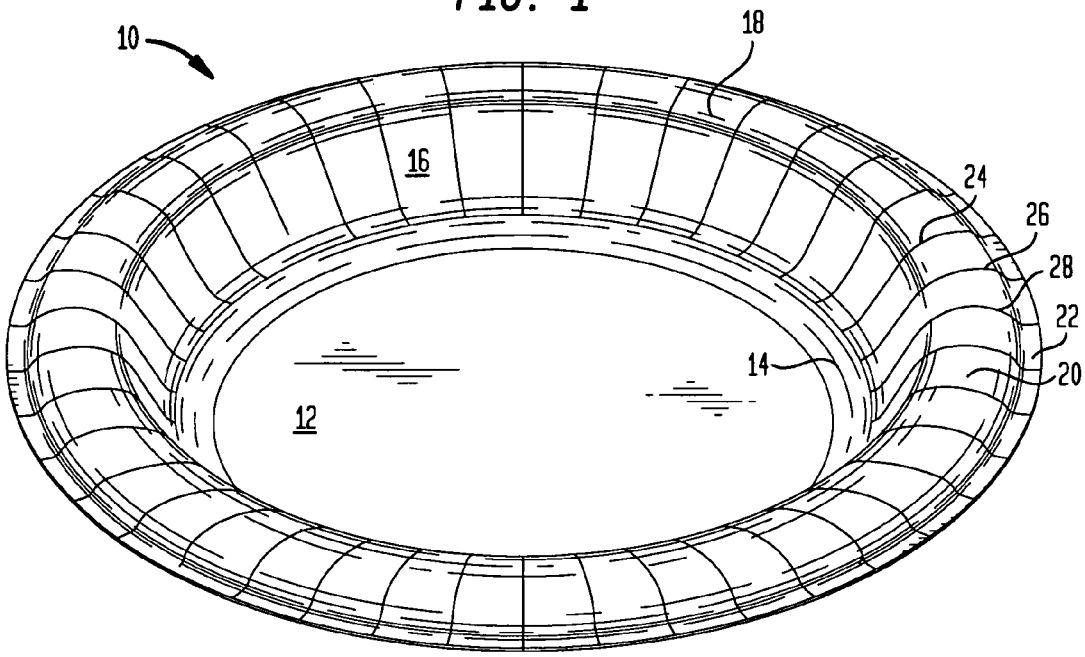
FIG. 1 is a perspective view of a pressed paperboard plate representative of the articles produced in connection with the present invention.
Figure 2:
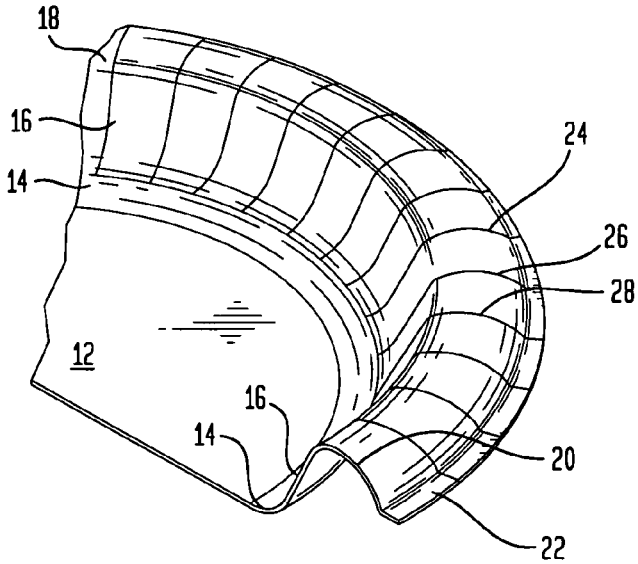
FIG. 2 is a view in partial section illustrating the profile of the plate of FIG. 1.

Referring now to FIGS. 1 and 2, there is illustrated a plate 10 made from a substantially planar paperboard blank. Plate 10 includes a planar bottom 12, a first transition 14, a sidewall 16, a second transition 18 and an arcuate outer flange portion 20. Optionally provided is an outer evert 22 which provides additional strength to the container. Pressed paperboard containers such as plate 10 typically include a plurality of pleats such as pleats 24, 26, 28 and so forth because of the excess paperboard located in a circumferential direction when a flat blank is formed into the shaped product, as will be appreciated by one skilled in the art.

Figure 3:
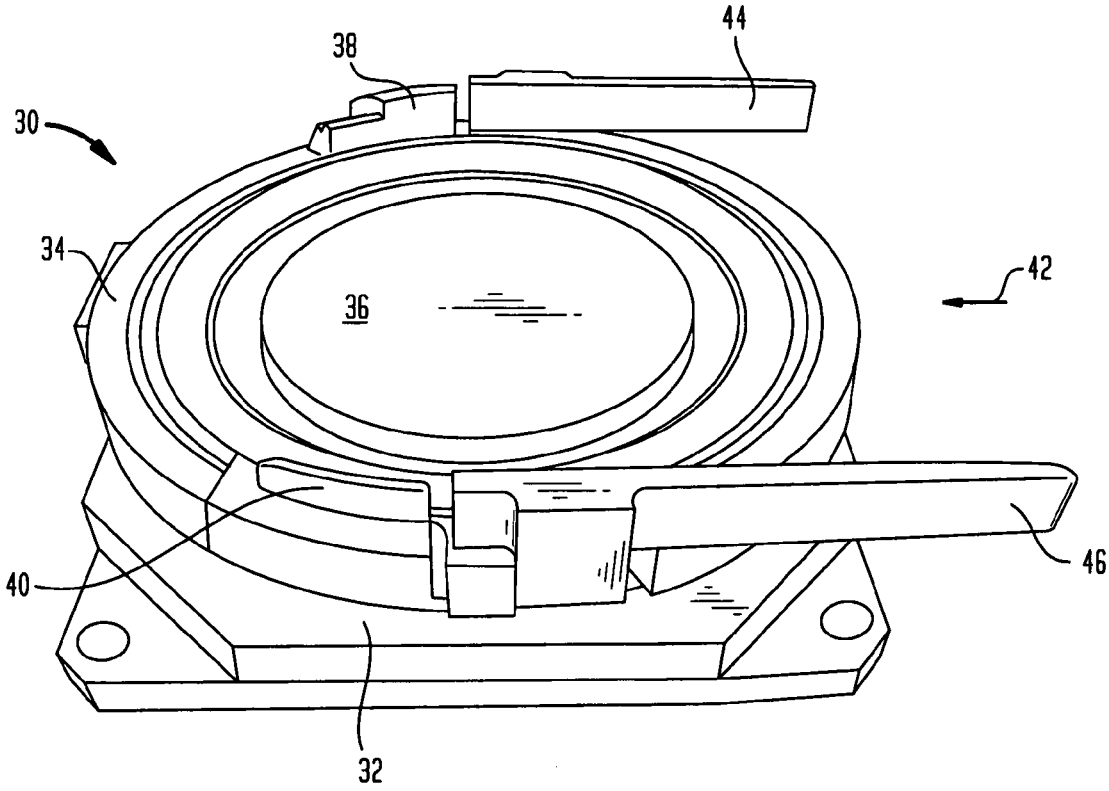
FIG. 3 is a schematic view in perspective of the die portion of a segmented die set of the class used to make pressware containers.

Referring to FIG. 3, a container such as plate 10 is typically formed in an automated pressware apparatus which includes a plurality of die sets, each including a punch and a die such as die 30. Die 30 is mounted on a mounting plate 32 and is optionally a segmented die including a draw ring 34, a knock-out 36 and a pair of forward blank stops 38, 40 as is shown. A flat paperboard blank is generally passively fed to die 30 by gravity, guided along a production direction 42 by blank guides 44, 46. The die set is typically inclined with respect to horizontal at an angle between 30° and 60° such as 45° so that blanks and product are advanced by gravity along an inclined feed path in plane 42 as is well known. However, pursuant to this invention, instead of relying solely upon a passive gravity feed system, it has been found that higher blank feeding speeds and more reliable press operation are achieved by pneumatically propelling the blank into the die set as is illustrated in FIGS. 4, 5, 6 and 7.

Figure 4:
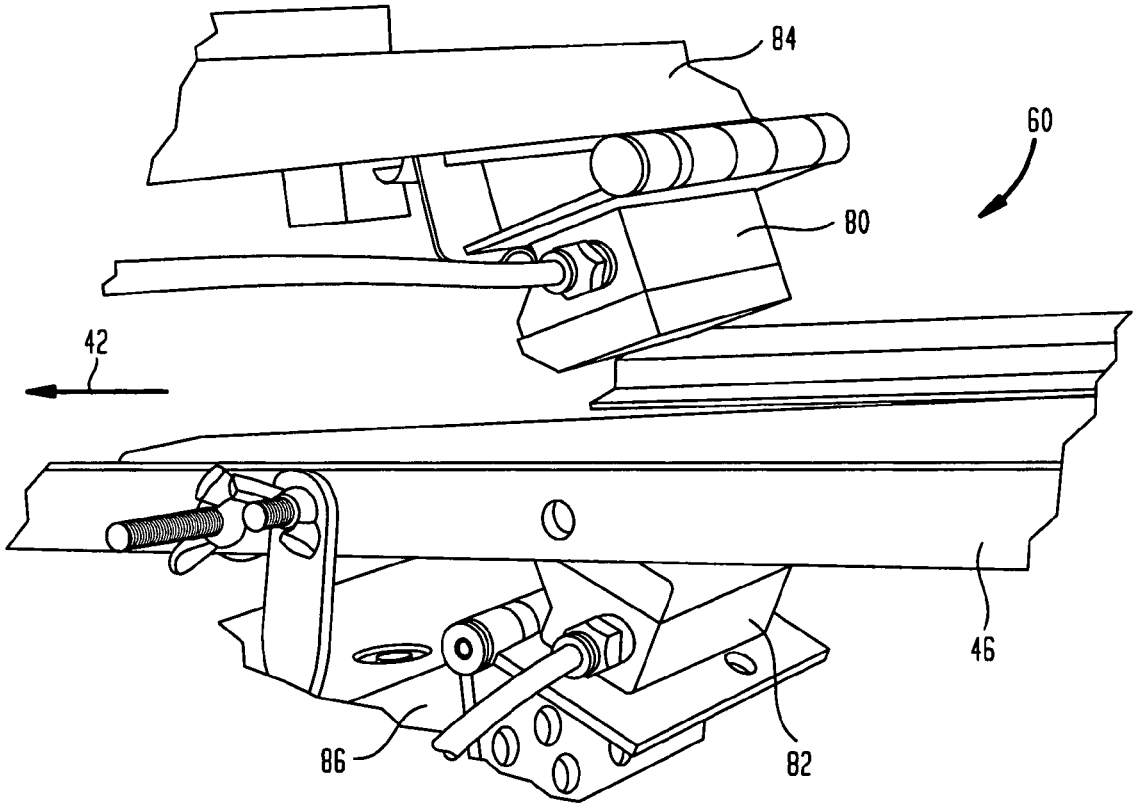
FIG. 4 is a partial perspective view of the feed section of an improved apparatus of the invention.
Figure 5:
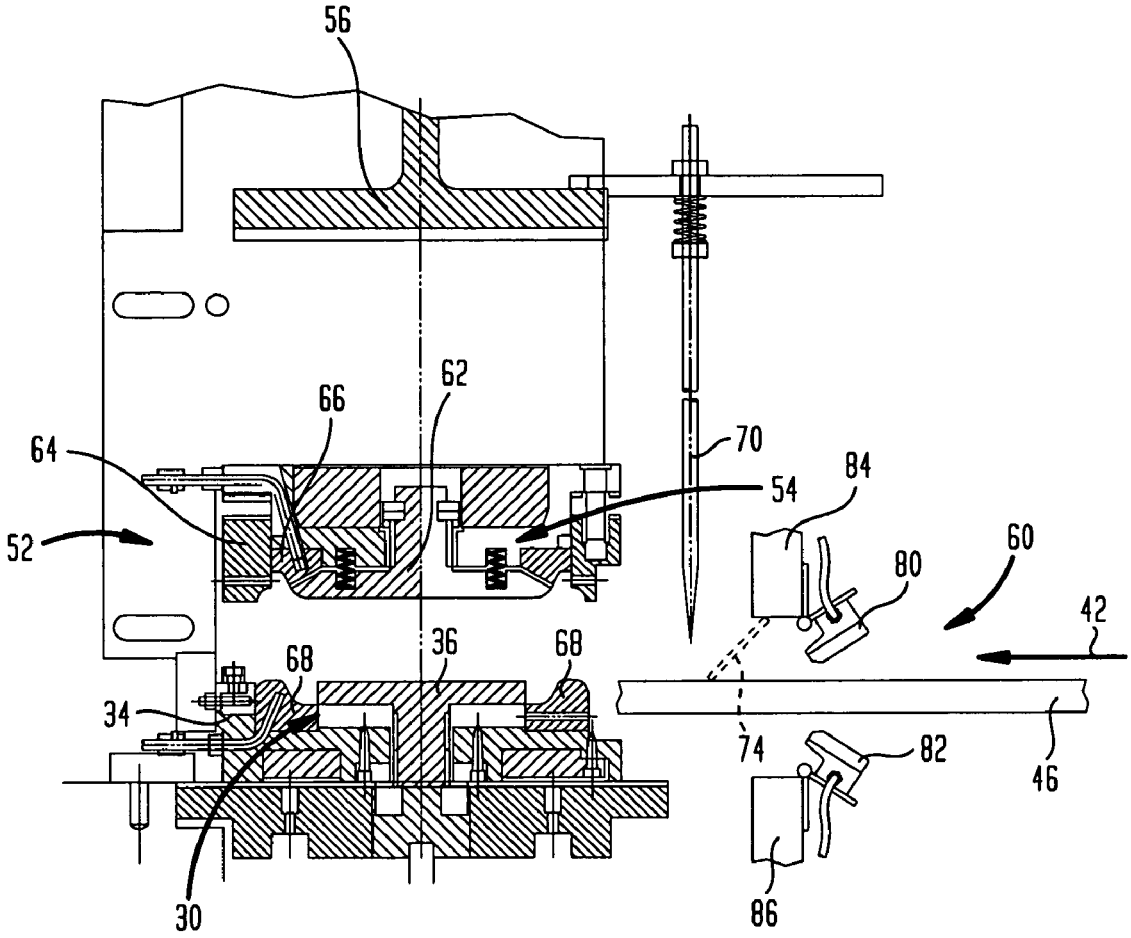
FIG. 5 is a schematic diagram of an apparatus of the invention.

As shown in FIGS. 4 and 5, the improved apparatus includes generally a pressware die set 52 including a punch 54 driven by a forming ram 56, as well as a die 30 and a blank feeding station 60. Punch 54 includes a knock-out 62, a pressure ring 64, and a punch base 66. The knock-out is optionally spring biased as shown. Die 30 has draw ring 34, knock-out 36 as well as base 68 which defines a contour transferred to the blank in order to form the container.

Figure 6:
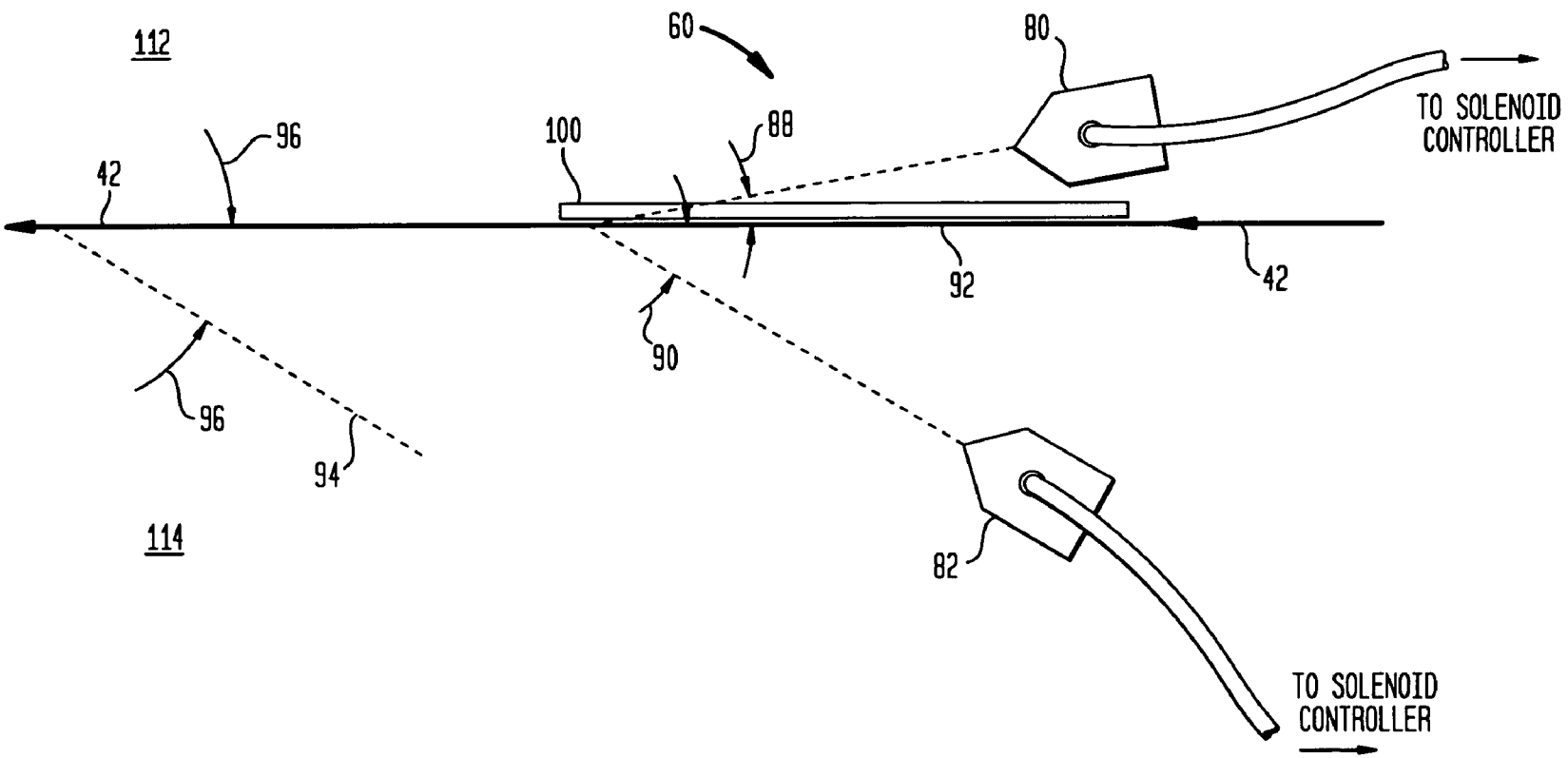
FIG. 6 is a diagram illustrating angles and operation of the apparatus of FIGS. 4 and 5.

As shown in FIG. 5, included in the blank feeding station 60 are optional stop pins such as an optional stop pin 70, as well as an optional damper plate 74 along with a pair of air knives 80, 82. Optional damper plate 74 may be positioned either before or after air knives 80, 82. As shown in FIGS. 4 and 6, air knives 80, 82 are adjustably mounted on respective supports 84, 86 such that their outputs form angles 88, 90, respectively (FIG. 6) with respect to production direction 42 which is parallel with the inclined plane of the feed station indicated at 92 in FIG. 6.

As shown in FIG. 6, plane 92 is typically and conventionally inclined with respect to a horizontal indicated at 94 such that blank 100 are gravity fed to pressware die set 52. The angle of inclination 96 may be anywhere from about 30 to about 60°; typically at an angle of about 45° with respect to horizontal. Angle 88 is suitably about 5°, or in other words, the output of upper air knife 80 makes an angle of about 50° with a horizontal when the feed path is inclined 45°. Angle 90 is suitably about 30° such that the output of lower air knife 82 makes an angle of about 15° with respect to a horizontal (75° to vertical) when the feed path is inclined to 45°. It will be appreciated that the angles of incidence on the paperboard blank can be selected for different paperboard weights, angles of inclination, operating speeds or equipment. The angle of incidence from the jet below the feed path is typically greater than the angle of incidence from the jet above the feed path; that is to say, angle 90 is suitably larger than angle 88. Angle 90 may in some cases be quite high if significant lift is needed in connection with propelling the blank into the die set.

An inclined feed path in the plane indicated at 92 extends in production direction 42 as indicated in FIG. 6. The inclined feed path extends in between air knives 80, 82 and has on upper side 112 where knife 80 is located on the same side of the plane as the punch and a lower side 114 where knife 82 is located on the same side of the plane as the die. Angle 88 is thus defined as an oblique angle of incidence which may be from 1° to 35° such as from 2° to 10° or from 3° to 7° with respect to the inclined feed path. Angle 90 is likewise an angle of incidence which may be from 5° to 60° such as from 10° to 50° or from 20° to 40° with respect to the inclined feed path. The angles are measured or adjusted using a digital protractor, for example, on the air knife casing which is parallel with the central axis of the issuing jet.

Figure 7:
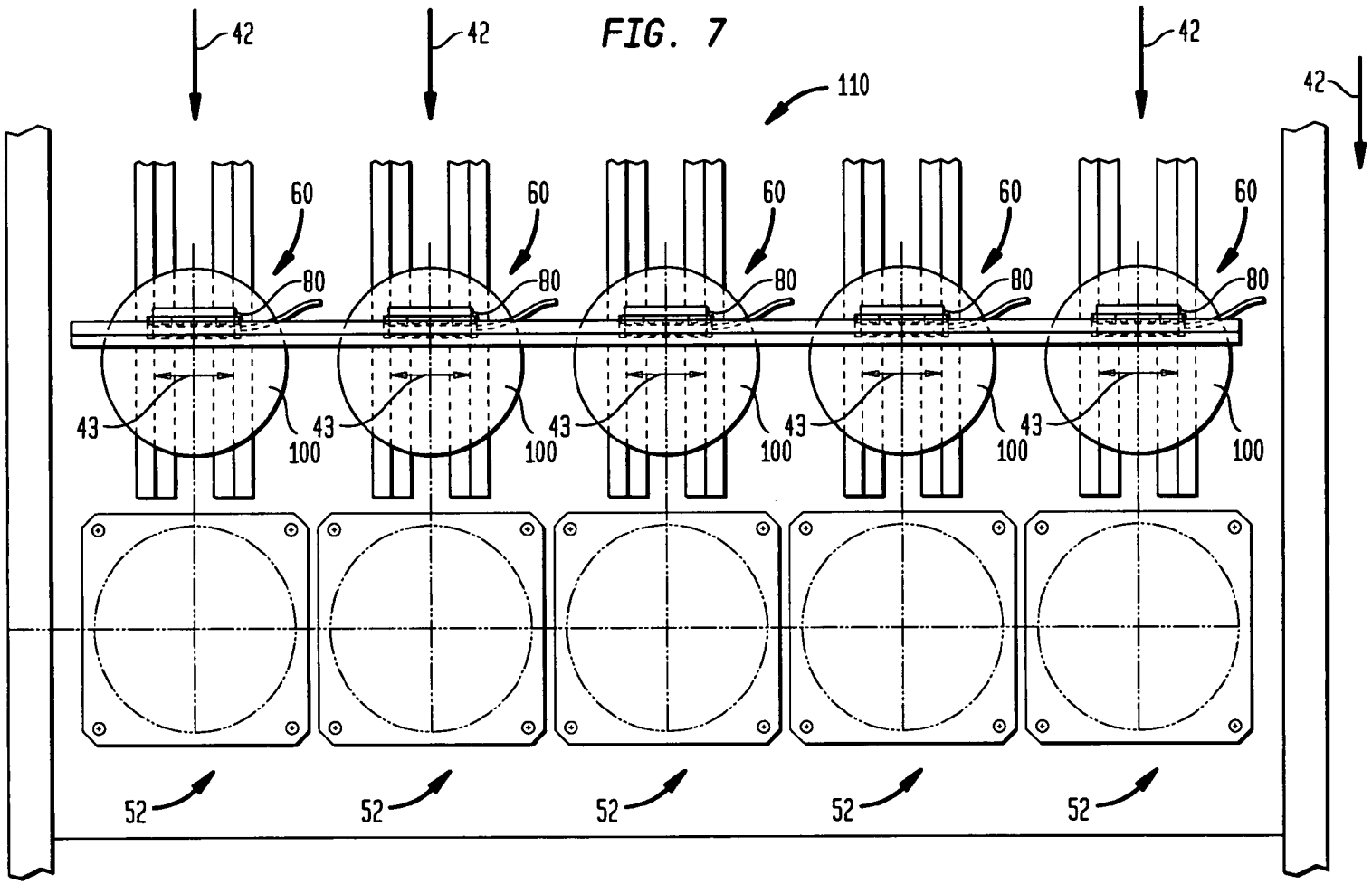
FIG. 7 is a schematic top view illustrating a plurality of die sets and associated feeding stations as would be arranged on a press.

FIG. 7 shows a plurality of feed stations 60, each holding blanks 100, and each having upper air knives 80 to propel blanks 100 into pressware die set 52. The axes of the slots of the air knives 80 and 82 (not shown) extend in direction 43 substantially perpendicular to the production direction 42.

Referring again to FIGS. 4, 5 and 6, in operation, paperboard blank 100 is gravity-fed or mechanically fed to feed station 60 where it is optionally stopped with a pin such as pin 70 mounted on the forming ram. Damper plate 74 helps limit bounce-back of blank 100 when it is stopped in feed station 60 at feed plane 92 in anticipation of the feed step.

The feed step begins after the previous container has been formed and removed. During the feed step, air knives 80, 82 are activated and supply air blasts incident on blank 100 as shown schematically in FIG. 7. The air blasts are at angles 88, 90 with respect to direction 42 and feed plane 92 and operate to accelerate the blank and propel it into die set 52, where the blank is formed into a container such as that shown in FIG. 1. As will be readily recognized, it may be possible to use a single air knife 80 or 82 above or below feed plane 92 to implement the invention, and multiple air knives in combination may be positioned above or below feed plane 92. In addition, the air knives preferably will be provided with means to adjust and control jet velocity, direction, and flow pattern to take into account the configuration of feed station 60 and blank guides 46, and the dimensions of blank 100, such as blank shape, width, thickness, surface friction, and weight.

A suitable air knife for upper or lower application is an Exair® Super Air Knife manufactured by EXAIR Corporation, Cincinnati, Ohio. Such an air knife is typically operated with an input air pressure of from about 40 to 80 psig. Other pressures are also suitable. Further information may be found at http://www.exair.com/airknife/sak_page.htm, Jun. 6, 2006, the disclosure of which is incorporated herein by reference. In one mode of operation air knife 80 is operated at 40 psi while air knife 82 is operated at 20 psi. The air knife may have the flow pattern shown in FIG. 8, where the jet issuing from the knife has a "spread" or a characteristic jet height of about 5" at one foot, although other spreads may be used. The jet velocity will typically be in excess of 10,000 fpm, and preferably 14,000 fpm, when the air knife is operated with an input air pressure of 40 psig. A 3" Super Air Knife is especially suitable for paperboard blanks having a diameter from about 6 to about 10 inches. This air knife has a characteristic force (measured on a 12 inch by 12 inch surface perpendicular to the jet flow path) of about 0.161 lbs. The force of the jet on the surface does not substantially change as the surface is moved away from the air knife at distances between 1" and 12". Suitably, the characteristic force is measured at 6" from the air knife.

In practical applications, the invention may be utilized in a five station press 110 as is shown in FIG. 7. In FIG. 7, there are provided five die sets 52 adjacent five blank feed stations 60, each of which has a pair of air knives as described above.

Simultaneously with propelling blank 100, air knives shown in FIGS. 3 through 8 may also, optionally, be used to reduce, remove or clear air turbulence created by reciprocal operation of pressware die set 52 thereby facilitating insertion of blank 100; to evacuate heat and moisture from die set 52 to better control the pressing environment; and to inject lubricants, coolants and other chemicals or substances in aerosol form into the die set to facilitate or enhance pressing or to impart desired characteristics to the pressed article; provided, however, all additives selected do not cause mold build-up or other operational difficulties.

Figure 9:
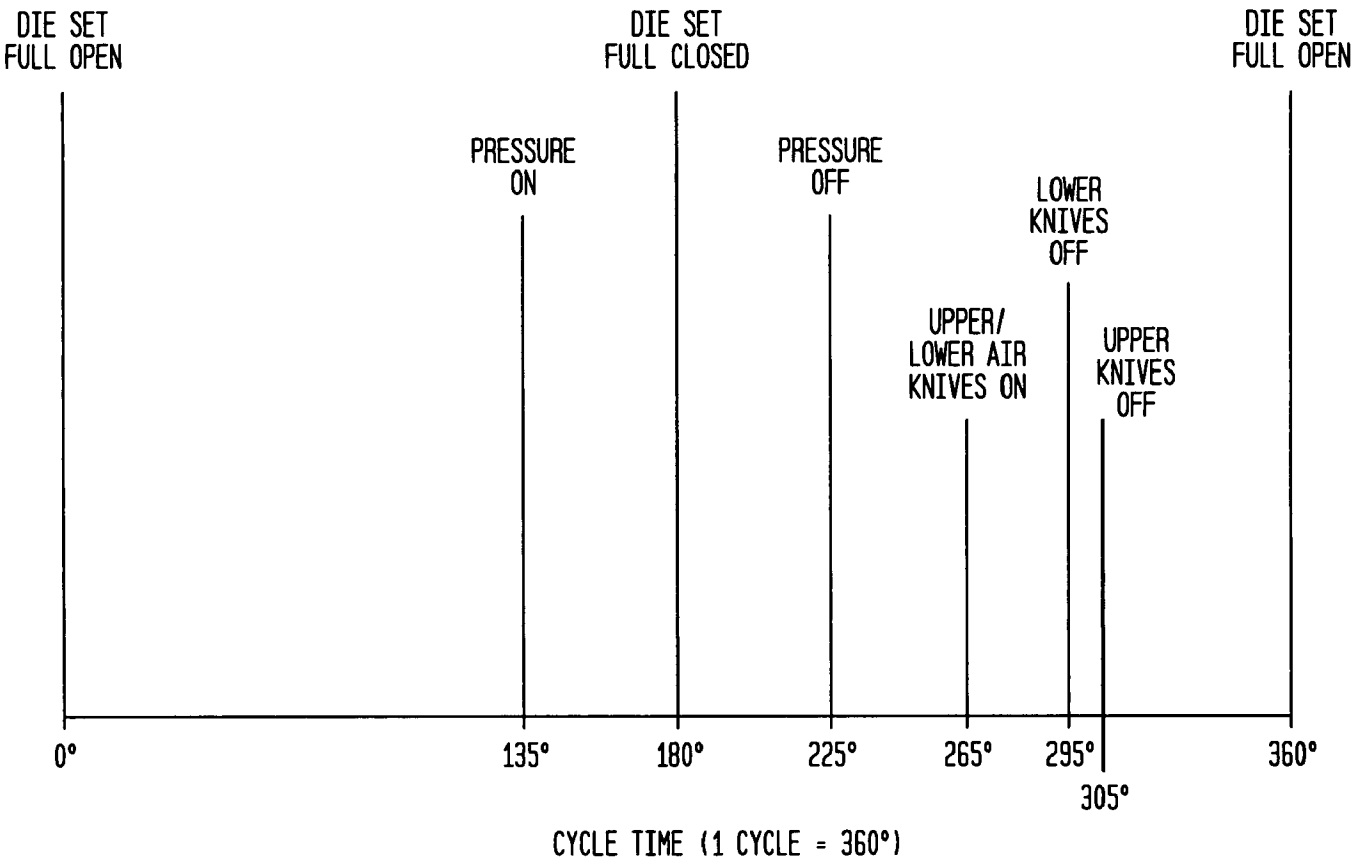
FIG. 9 is a timing diagram illustrating a 360° forming cycle of a pressware die set.

The invention is still further illustrated in FIG. 9 which is a schematic timing diagram illustrating operation of the invention apparatus, it being appreciated that air knives, such as air knives 80, 82 are controlled using a solenoid valve controller as indicated in FIG. 6 in order to synchronize the air knives with operation of the forming press. Any suitable controller may be used. In FIG. 9, a forming cycle is represented in time by degrees of the operating cycle. At 0° the die set is fully open; at 135° the press hydraulic pressure is applied; at 180° the die set is fully closed for forming; at 225° the hydraulic pressure is released; and at about 265° the air knives are turned on, that is, the output jets are activated. The lower air knife remains on until about 295°, while the upper air knife remains on until about 305°. At 360° the die set is again fully open. Suitable ranges are also as follows:

TABLE 1

| | Air Knife On/Off Cycle Position | |
|---|---|---|
| | ON AT | OFF AT |
| Upper Air Knife | 250°-280° | 290°-320° |
| | 255°-275° | 295°-315° |
| Lower Air knife | 250°-280° | 280°-310° |
| | 255°-275° | 285°-305° |

The knives remain active within the interval between on and off times selected from Table 1.

While the invention has been described in connection with several examples, modifications to those examples within the spirit and scope of the invention will be readily apparent to those of skill in the art. In view of the foregoing discussion, relevant knowledge in the art and references including co-pending applications discussed above in connection with the Claim for Priority, Background and Detailed Description, further description is deemed unnecessary.

What is claimed is:

1. A pressware apparatus for making pressed paperboard containers comprising:

a) an inclined die set including a punch and a die adapted for reciprocal motion with respect to each other and configured to cooperate in order to form a shaped product from a substantially planar paperboard blank upon pressing thereof;

b) an inclined feed station for positioning a paperboard blank for insertion into said die set along an inclined feed path;

c) a first air knife upwardly disposed with respect to the feed station having a pneumatic outlet directed toward said feed path; and d) a second air knife downwardly disposed with respect to the feed station having a pneumatic outlet directed toward said feed path;

wherein said first and second air knives are selected and positioned so as to cooperate to propel the paperboard blank into the die set.

2. The apparatus according to claim 1, wherein the die set and feed path are inclined at an angle of from 30° to 60° with respect to horizontal.

3. The apparatus according to claim 1, wherein the pneumatic outlet of the first, upwardly disposed air knife defines an oblique angle of incidence of from 1° to 35° with respect to the inclined feed path.

4. The apparatus according to claim 1, wherein the pneumatic outlet of the first, upwardly disposed air knife defines an oblique angle of incidence of from 2° to 10° with respect to the inclined feed path.

5. The apparatus according to claim 1, wherein the pneumatic outlet of the first, upwardly disposed air knife defines an oblique angle of incidence of from 3° to 7° with respect to the inclined feed path.

6. The apparatus according to claim 1, wherein the pneumatic outlet of the second, downwardly disposed air knife defines an oblique angle of incidence of from 5° to 60° with respect to the inclined feed path.

7. The apparatus according to claim 1, wherein the pneumatic outlet of the second, downwardly disposed air knife defines an oblique angle of incidence of from 10° to 50° with respect to the inclined feed path.

8. The apparatus according to claim 1, wherein the pneumatic outlet of the second, downwardly disposed air knife defines an oblique angle of incidence of from 20° to 40° with respect to the inclined feed path.

9. The apparatus according to claim 1, further comprising stop means for retaining a paperboard blank in the feed station such that the blank is stationary while a container is formed from another blank.

10. The apparatus according to claim 1, further comprising control means for synchronizing the air knives with reciprocal motion of the die set, wherein the air knives are active during feeding of a blank to the die set and inactive during formation of a container.

* * * * *